US009931871B2

(12) United States Patent
Hirata

(10) Patent No.: US 9,931,871 B2
(45) Date of Patent: Apr. 3, 2018

(54) DISCHARGE APPARATUS AND DETACHABLE TRAY

(71) Applicant: BROTHER KOGYO KABUSHIKI KAISHA, Nagoya-shi, Aichi-ken (JP)

(72) Inventor: Kenichi Hirata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/265,684

(22) Filed: Sep. 14, 2016

(65) Prior Publication Data

US 2017/0087887 A1 Mar. 30, 2017

(30) Foreign Application Priority Data

Sep. 30, 2015 (JP) ..... 2015-194090

(51) Int. Cl.
*B41J 11/58* (2006.01)
*B65H 43/06* (2006.01)
(Continued)

(52) U.S. Cl.
CPC ..... *B41J 11/58* (2013.01); *B41J 13/106* (2013.01); *B65H 29/52* (2013.01); *B65H 31/02* (2013.01);
(Continued)

(58) Field of Classification Search
CPC . B41J 13/106; B65H 31/34; B65H 2301/4462
(Continued)

(56) References Cited

U.S. PATENT DOCUMENTS 5,286,018 A * 2/1994 Rasmussen ..... B65H 1/04 271/145
2003/0081101 A1* 5/2003 Khormaei ..... B41J 13/103 347/104
(Continued)

FOREIGN PATENT DOCUMENTS

JP 2000072317 A * 3/2000
JP 2001-225963 A 8/2001
(Continued)

OTHER PUBLICATIONS

Machine generated English translation of JP2010-013221A "Paper Sheet Handling Device" to Sato et al.; translation generated via https://www4.j-platpat.inpit.go.jp/eng/tokujitsu/tkbs_en/TKBS_EN_GM101_Top.action on Jul. 17, 2017; 6pp.*

*Primary Examiner* — Shelby Fidler
(74) *Attorney, Agent, or Firm* — Merchant & Gould P.C.

(57) ABSTRACT

A discharge apparatus includes: a discharge mechanism including a discharge port and discharging a recording medium from the discharge port in a first direction; a receiving member having a receiving surface which receives the recording medium discharged from the discharge port; an abutting member having an abutting surface which abuts against an upstream end or a downstream end in the first direction of the recording medium received by the receiving surface; and guide members extending upward beyond the receiving surface and guiding the recording medium which is discharged from the discharge port to fall toward the receiving surface, from both sides in a second direction orthogonal to the first direction and parallel to the receiving surface. The guide members respectively include protruding portions protruding inward in the second direction and extending in a longitudinal direction of the guide members.

15 Claims, 11 Drawing Sheets

(51) Int. Cl.

| | |
|---|---|
| ***B65H 31/26*** | (2006.01) |
| ***B65H 31/02*** | (2006.01) |
| ***B65H 31/22*** | (2006.01) |
| ***B65H 31/34*** | (2006.01) |
| ***B41J 13/10*** | (2006.01) |
| ***B65H 31/20*** | (2006.01) |
| ***G03G 15/00*** | (2006.01) |
| ***B65H 29/52*** | (2006.01) |

(52) U.S. Cl.
CPC ..... *B65H 31/20* (2013.01); *B65H 31/22* (2013.01); *B65H 31/26* (2013.01); *B65H 31/34* (2013.01); *B65H 43/06* (2013.01); *G03G 15/6552* (2013.01); *B65H 2404/54* (2013.01); *B65H 2404/74* (2013.01); *B65H 2405/114* (2013.01); *B65H 2405/1124* (2013.01); *B65H 2405/1136* (2013.01); *B65H 2405/11151* (2013.01); *B65H 2405/11152* (2013.01); *B65H 2511/10* (2013.01); *B65H 2511/20* (2013.01); *B65H 2553/612* (2013.01)

(58) Field of Classification Search
USPC ..... 271/240
See application file for complete search history.

(56) References Cited

U.S. PATENT DOCUMENTS

| | | | | |
|---|---|---|---|---|
| 2003/0180078 | A1 | 9/2003 | Lyon et al. | |
| 2008/0272536 | A1* | 11/2008 | Inoue | B65H 3/06 271/109 |
| 2010/0066005 | A1* | 3/2010 | Ueda | B65H 31/02 271/3.17 |
| 2012/0147112 | A1* | 6/2012 | Tanaka | B41J 13/106 347/104 |
| 2015/0183606 | A1* | 7/2015 | Nishi | B65H 31/02 271/234 |
| 2016/0325961 | A1* | 11/2016 | Kojima | B65H 31/34 |

FOREIGN PATENT DOCUMENTS

| | | | |
|---|---|---|---|
| JP | 2003-276929 | A | 10/2009 |
| JP | 2010013221 | A * | 1/2010 |

* cited by examiner

DISCHARGE APPARATUS AND DETACHABLE TRAY

CROSS REFERENCE TO RELATED APPLICATION

The present application claims priority from Japanese Patent Application No. 2015-194090 filed on Sep. 30, 2015, the disclosure of which is incorporated herein by reference in its entirety.

BACKGROUND OF THE INVENTION

Field of the Invention

The present invention relates to a discharge apparatus configured to discharge a recording medium and a detachable tray.

Description of the Related Art

Japanese Patent Application laid-open No. 2001-225963 describes an electrophotographic recording apparatus including a printer body by which an image is printed on a paper sheet fed from a feed unit and a discharge unit on which the paper sheet discharged from the printer body is supported. The discharge unit of such an electrophotographic recording apparatus includes rear guides each of which has a plate-like body extending perpendicularly and a stacking plate which is disposed between the rear guides to support the paper sheet discharged from the printer body. The paper sheet discharged from a discharge port of the printer body is guided by the rear guides, and then it is stacked on the stacking plate disposed below the discharge port while the movement of the paper sheet in a width direction is regulated.

SUMMARY OF THE INVENTION

In the technology disclosed in Japanese Patent Application laid-open No. 2001-225963, each paper sheet discharged from the discharge port is aligned by the bodies of the rear guides and then stacked on the stacking plate. To improve the paper aligning property on the stacking plate, the distance between the bodies of the rear guides should not be too large as compared with the paper width. However, if the distance between the bodies of the rear guides is short, a paper sheet discharged from the discharge port with skew may get jammed. Meanwhile, if the distance between the bodies of the rear guides is considerably larger than the paper width, the stacked positions of paper sheets are more likely to vary in the width direction.

An object of the present teaching is to provide a discharge apparatus and a detachable tray which are capable of improving the aligning property of a recording medium while preventing the recording medium discharged from a discharge port with skew from getting jammed between guide members.

According to a first aspect of the present teaching, there is provided a discharge apparatus, including:

a discharge mechanism including a discharge port and configured to discharge a recording medium from the discharge port in a first direction;

a receiving member having a receiving surface which receives the recording medium discharged from the discharge port;

an abutting member having an abutting surface which abuts against an upstream end or a downstream end in the first direction of the recording medium received by the receiving surface;

guide members extending upward beyond the receiving surface and configured to guide the recording medium, which is discharged from the discharge port to fall toward the receiving surface, from both sides in a second direction orthogonal to the first direction and parallel to the receiving surface;

wherein the guide members respectively include protruding portions protruding inward in the second direction and extending in a longitudinal direction of the guide members, and the guide members are disposed at positions where leading ends of the protruding portions make contact with both sides in the second direction of the recording medium which is discharged from the discharge port to fall toward the receiving surface.

The discharge apparatus according to the first aspect of the present teaching includes the guide members having the protruding portions respectively. This improves the aligning property of the recording medium while preventing the recording medium discharged from the discharge port with skew from getting jammed between the guide members, without greatly lengthening the distance between the guide members (the leading ends of the protruding portions) relative to the width of the recording medium.

According to a second aspect of the present teaching, there is provided a detachable tray to be installed to a receiving tray of a discharge apparatus, the discharge apparatus including: a discharge mechanism including a discharge port and configured to discharge a recording medium from the discharge port in first direction; and the receiving tray configured to receive the recording medium discharged from the discharge port, the detachable tray including:

a receiving member disposed on the receiving tray and having a receiving surface which receives the recording medium discharged from the discharge port; and guide members extending upward beyond the receiving surface and configured to guide the recording medium, which is discharged from the discharge port to fall toward the receiving surface, from both sides in a second direction orthogonal to the first direction and parallel to the receiving surface, wherein the guide members respectively include protruding portions protruding inward in the second direction and extending in a longitudinal direction of the guide members, and the guide members are disposed at positions where leading ends of the protruding portions make contact with both sides in the second direction of the recording medium which is discharged from the discharge port to fall toward the receiving surface.

The detachable tray according to the second aspect of the present teaching includes the guide members having the protruding portions respectively. This improves the aligning property of the recording medium while preventing the recording medium discharged from the discharge port with skew from getting jammed between the guide members, without greatly lengthening the distance between the guide members (the leading ends of the protruding portions) relative to the width of the recording medium.

DESCRIPTION OF THE EMBODIMENTS

Figure 1:
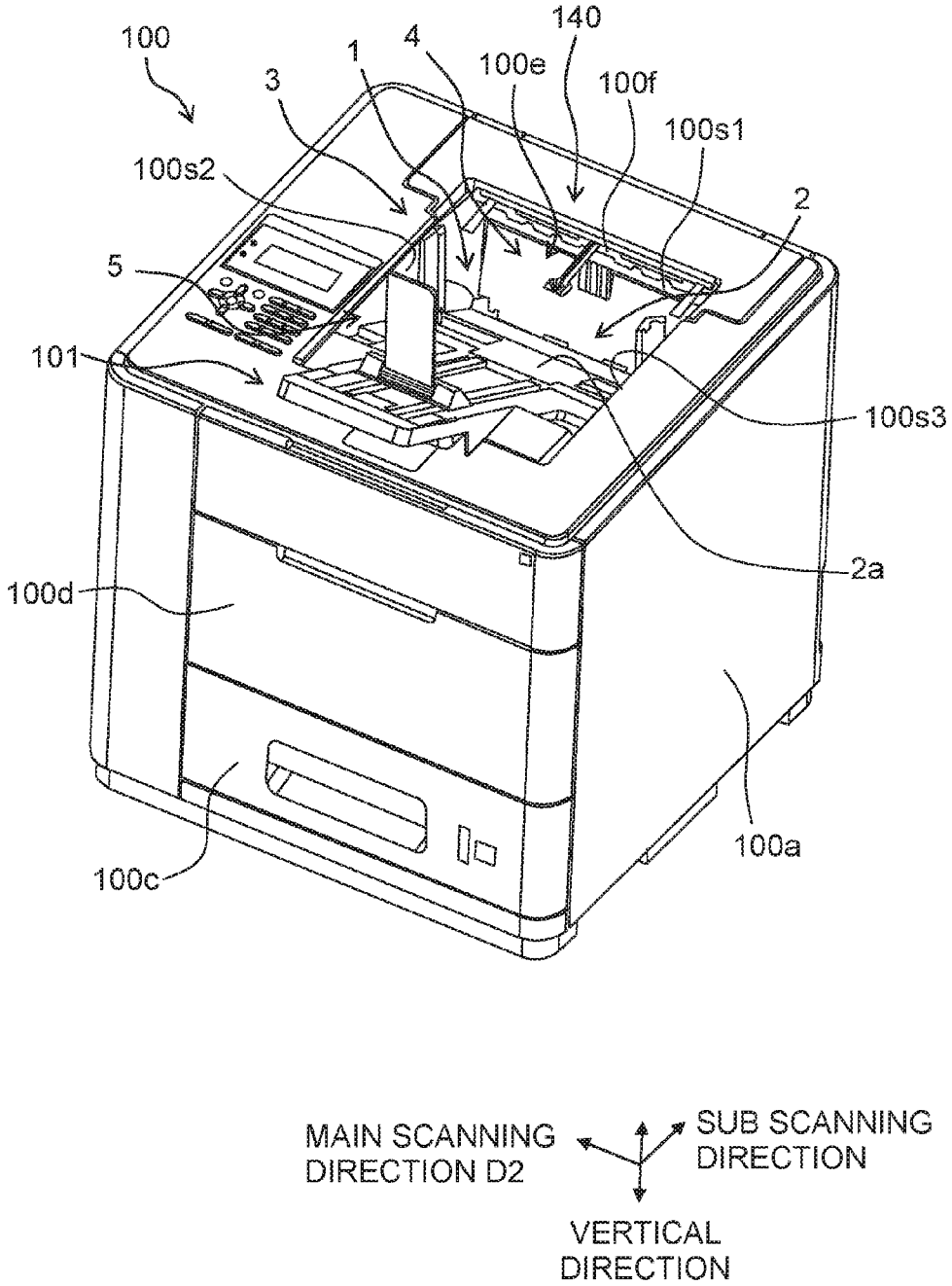
FIG. 1 is a perspective view of an ink-jet printer including a discharge apparatus according to an embodiment of the present teaching.

An explanation will be made, with reference to FIGS. 1 to 4, about an ink-jet printer (hereinafter simply referred to as "printer") 100 including a discharge apparatus 101 according to an embodiment of the present teaching. As depicted in FIG. 1, the printer 100 includes a substantially rectangular parallelepiped casing 100*a*. An openable and closable manual feed tray 100*d* is provided in a front surface (a surface on a left front side in FIG. 1, a surface on a left side in FIG. 2) of the casing 100*a*. A receiving tray 100*e* is provided in an upper part of a top plate of the casing 100*a*. A discharge port 100*f* from which a paper sheet P is discharged on the receiving tray 100*e* is formed at an upper part of the casing 100*a*. The discharge port 100*f* is an opening formed in the casing 100*a*. A pressing part 140 is provided in the vicinity of the discharge port 100*f* of the casing 100*a*.

Figure 2:
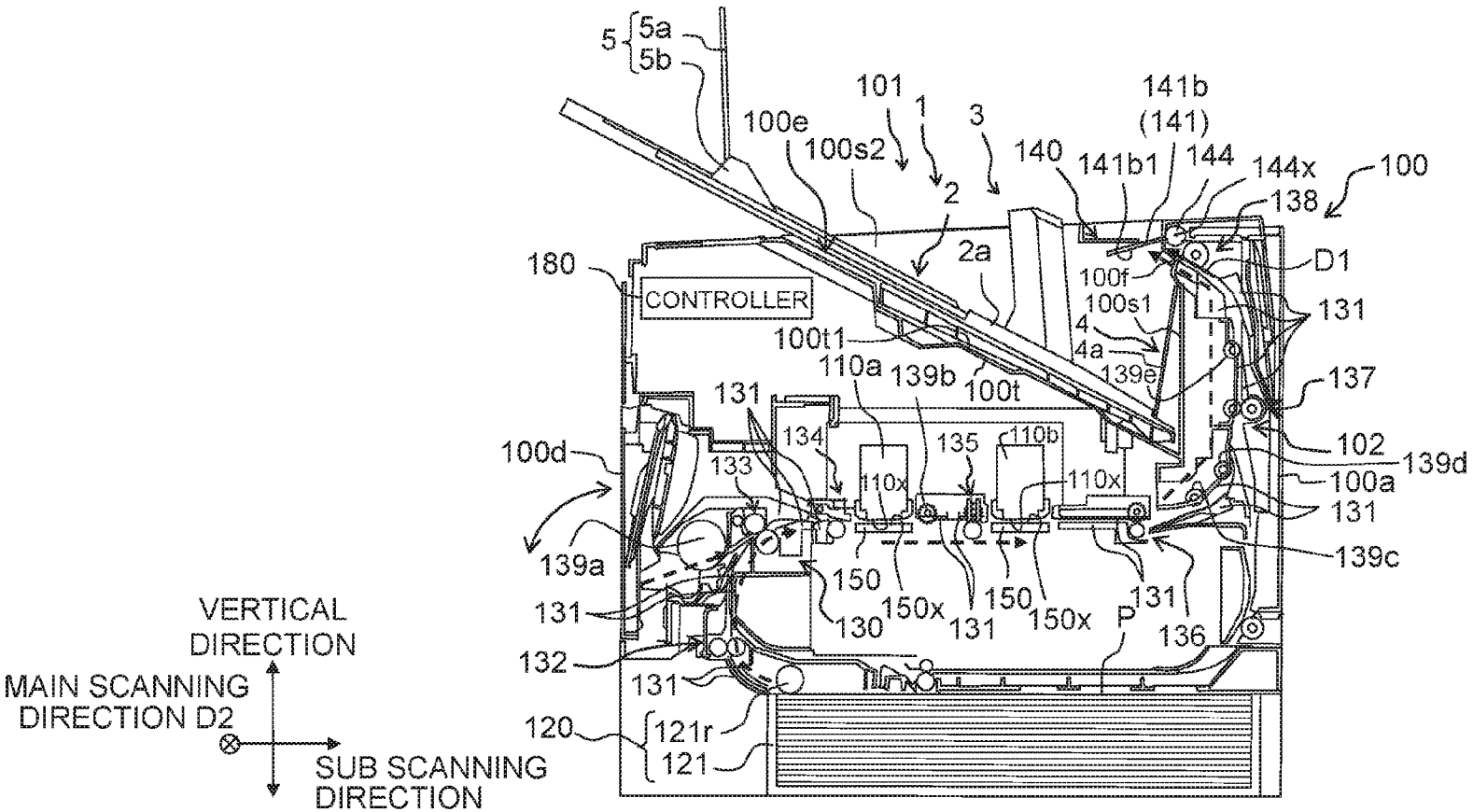
FIG. 2 is a schematic side view depicting an internal structure of the printer depicted in FIG. 1.

As depicted in FIGS. 1 and 2, the receiving tray 100*e* is constructed of an upper wall 100*t* of the casing 100*a* and three side walls 100*s*1 to 100*s*3 extending vertically. As depicted in FIG. 2, an upper end of the side wall 100*s*1 defines the discharge port 100*f* and a lower end of the side wall 100*s*1 faces an upstream end of the upper wall 100*t* in a first direction D1 (a direction in which the paper sheet P is discharged from the discharge port 100*f*). The two side walls 100*s*2 and 100*s*3 are formed to extend vertically from both ends of the upper wall 100*t* in a main scanning direction D2 (a second direction which is orthogonal to the first direction D1 and is parallel to a receiving surface 2*a*). The upper wall 100*t* includes an inclined surface 100*t*1 which is inclined to a horizontal plane. The inclined surface 100*t*1 is inclined such that its downstream end in the first direction D1 is positioned above its upstream end. A detachable tray 1 is installed onto the receiving tray 100*e*.

As depicted in FIG. 2, a head 110*a* which jets a pretreatment liquid preventing the bleed and bleed-through of ink and improving the color and drying speed of ink, a head 110*b* which jets an ink, two platens 150, a feed mechanism 120, a conveyance mechanism 130, and a controller 180 are disposed in an internal space of the casing 100*a*. The discharge apparatus 101 of this embodiment is constructed of the detachable tray 1 and a discharge mechanism 102. The discharge mechanism 102 includes the conveyance mechanism 130 and the side wall 100*s*1 defining the discharge port 100*f*.

The heads 110*a* and 110*b*, which have the same structure, are formed in an approximately rectangular parallelepiped shape which is long in the main scanning direction D2. Namely, the printer 100 is a line-type ink-jet printer. Each of the heads 110*a* and 110*b* includes a channel unit in which channels with pressure chambers are formed and an actuator which applies pressure to the liquid (the pretreatment liquid or the ink) of each pressure chamber. The bottom surface of the channel unit is a jetting surface 110*x* with jetting ports from which the pretreatment liquid or the ink is jetted. The pretreatment liquid is supplied from a cartridge (not depicted) storing the pretreatment liquid to the channel unit of the head 110*a*. The ink is supplied from a cartridge (not depicted) storing the ink to the channel unit of the head 110*b*.

The platens 150 are provided for the heads 110*a* and 110*b* respectively. Each platen 150 is a flat plate member. The platens 150 are respectively disposed below the heads 110*a* and 110*b* to face the jetting surfaces 110*x* of the heads 110*a* and 110*b* while being separated therefrom in a vertical direction. The surface of each platen 150 is a support surface 150*x* which supports the paper sheet P for which recording is performed by the heads 110*a* and 110*b*.

The feed mechanism 120 includes a feed tray 121 in which paper sheets P are accommodated and a feed roller 121*r* which is attached to the feed tray 121. The feed tray 121 is installable or detachable with respect to the casing 100*a* in a sub scanning direction. The controller 180 performs the control so that the drive of a feed motor (not depicted) rotates the feed roller 121*r* to teed an uppermost paper sheet P of the paper sheets P in the feed tray 121.

The conveyance mechanism 130 includes a guide 131, roller pairs 132 to 138, and rollers 139*a* to 139*e*. The guide 131 forms a conveyance route of the paper sheet P which extends from the feed mechanism 120, passes between the jetting surfaces 110*x* of two heads 110*a*, 110*b* and the support surfaces 150*x*, and reaches the detachable tray 1 on the receiving tray 100*e* and a conveyance route of the paper sheet P which extends from the manual feed tray 100*d*, passes between the jetting surfaces 110*x* of two heads 110*a*, 110*b* and the support surfaces 150*x*, and reaches the detachable tray 1 on the receiving tray 100*e*. The roller pairs 132 to 138 and the rollers 139*a* to 139*e* are disposed along the conveyance routes. The controller 180 performs the control so that the drive of a conveyance motor (not depicted) rotates the roller pairs 132 to 138 to apply conveyance force to the paper sheet P fed from the feed mechanism 120.

When the paper sheet P conveyed by the conveyance mechanism 130 passes between the jetting surfaces 110*x* of the heads 110*a*, 110*b* and the support surfaces 150*x*, the controller 180 controls the heads 110*a* and 110*b* to jet liquids from jetting ports. An image is formed on the paper sheet P by allowing the jetted liquids to land on the paper sheet P. The paper sheet P on which the image is formed (for which recording is performed) is discharged from the discharge port 100*f* in the first direction D1 and then is received by the detachable tray 1 on the receiving tray 100*e*. The first direction D1 intersects a common tangent of two rollers constituting the roller pair 138, and it is orthogonal to the main scanning direction (second direction) D2.

Figure 3:
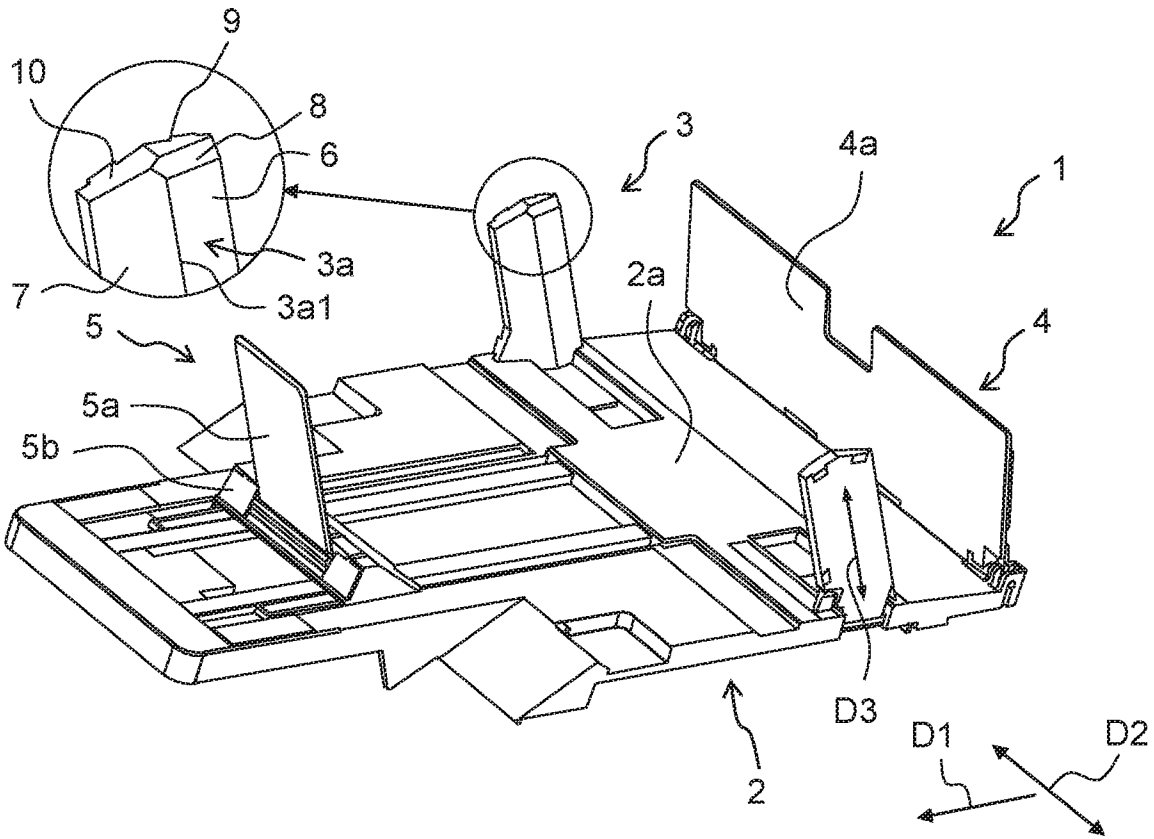
FIG. 3 is a perspective view of a detachable tray depicted in FIG. 1.

As depicted in FIG. 3, the detachable tray 1 includes a receiving member 2, a pair of guide members 3, an abutting member 4, and a stopper 5. The receiving member 2 includes the receiving surface 2*a* which receives the paper sheet P discharged from the discharge port 100*f*. As depicted in FIG. 2, the receiving surface 2*a* is inclined such that its downstream end in the first direction D1 is positioned above its upstream end with the detachable tray 1 installed to the receiving tray 100*e*. The receiving surface 2*a* is a flat surface along the main scanning direction D2. In this embodiment, a direction, which is parallel to the receiving surface 2*a* and orthogonal to the main scanning direction D2, is substantially parallel to the first direction D1.

As depicted in FIG. 3, the guide members 3 are installed to the receiving member 2 at positions between the center and the upstream end of the receiving member 2 in the first direction D1 to be movable in the main scanning direction D2. Each of the guide members 3 is constructed of a plate-like member extending upward in a longitudinal direction D3 beyond the receiving surface 2*a*.

Each of the guide members 3 includes a tapered portion 3*a* which is tapered inward in the main scanning direction D2. The tapered portion 3*a* is formed such that its center part in a width direction orthogonal to the longitudinal direction D3 of the guide member 3 protrudes inward, resulting in a sharp front edge 3*a*1. The front edge 3*a*1 of the tapered portion 3*a* can come into point contact with the paper sheet P. The tapered portion 3*a* is continuously formed along the longitudinal direction D3 of the guide member 3.

The guide members 3 are disposed such that the front edges 3*a*1 of the tapered portions 3*a* face each other in the main scanning direction D2. The guide members 3 are disposed such that the front edges 3*a*1 of the tapered portions 3*a* make contact with both sides in the main scanning direction D2 of the paper sheet P which is discharged from the discharge port 100*f* to fall toward the receiving surface 2*a*, with the detachable tray 1 installed in the receiving tray 100*e*. The guide members 3 guide the paper sheet P on both sides in the main scanning direction D2.

As depicted in FIG. 2, each of the guide members 3 extends while being inclined such that the front edge 3*a*1 of the tapered portion 3*a* is inclined toward the downstream side in the first direction D1 from its lower side to its upper side. In other words, the front edge 3*a*1 of each of the tapered portions 3*a* extends while being inclined such that its upper part is positioned more downstream in the first direction D1 than its lower part, with the detachable tray 1 installed to the receiving tray 100*e*.

As depicted in FIG. 3, each of the guide members 3 includes four inclined surfaces 6 to 9. The inclined surface 6, which constitutes a part of an inner side surface of the guide member 3, is positioned at an upstream end of the guide member 3 in the first direction D1. The inclined surface 6 is inclined inward in the main scanning direction D2 from the upstream end of the guide member 3 to the front edge 3*a*1 of the tapered portion 3*a*. The inclined surface 6 extends from the upstream end to the front edge 3*a*1 of the guide member 3.

The inclined surface 7, which constitutes a part of the inner side surface of the guide member 3, is positioned at a downstream end of the guide member 3 in the first direction D1. The inclined surface 7 is inclined inward in the main scanning direction D2 from the downstream end of the guide member 3 to the front edge 3*a*1 of the tapered portion 3*a*. The inclined surface 7 extends from the downstream end to the front edge 3*a*1 of the guide member 3.

The inclined surface 8, which constitutes a part of an upper surface of the guide member 3, is positioned at an upper end of the guide member 3. The inclined surface 8 is inclined upward from an inner end of the guide member 3 in the main scanning direction D2 to an outer end. The inclined surface 8 extends from the upstream end of the guide member 3 in the first direction D1 to the front edge 3*a*1.

The inclined surface 9, which constitutes apart of the upper surface of the guide member 3, is positioned at the upper end of the guide member 3. The inclined surface 9 is inclined upward from its upstream end in the first direction D1 to downstream end. The inclined surface 9 extends from the upstream end of the guide member 3 in the first direction D1 to the center of the guide member 3. The inclined surface 9 is disposed outside the inclined surface 8 in the main scanning direction D2.

A surface 10, which constitutes a part of the upper surface of the guide member 3, is positioned at the upper end of the guide member 3. The surface 10 is a substantially horizontal surface with the detachable tray 1 installed in the receiving tray 100*e*.

As depicted in FIGS. 2 and 3, the abutting member 4, which is constructed of a flat plate, is installed to an upstream end of the receiving member 2 in the first direction D1. Namely, the abutting member 4 is provided upstream of the receiving surface 2*a* of the receiving member 2 in the first direction D1. The abutting member 4 is swingably installed to the receiving member 2. As depicted in FIG. 2, the abutting member 4 is disposed to face the side wall 100*s*1 and extend upward beyond the receiving surface 2*a* with the detachable tray 1 installed in the receiving tray 100*e*. The abutting member 4 has an abutting surface 4*a* which abuts against an upstream end of the paper sheet P discharged from the discharge port 100*f* to be received by the receiving surface 2*a*. The abutting surface 4*a* is a flat surface in the main scanning direction D2.

As depicted in FIG. 2, an upper end of the stopper 5 is positioned above the receiving surface 2*a*. The stopper 5 is installed to a part, of the receiving member 2, positioned downstream of the receiving surface 2*a* in the first direction D1 so as to abut against a downstream end of the paper sheet P discharged from the discharge port 100*f*. Namely, the stopper 5 prevents the paper sheet P from falling out of the receiving surface 2*a*. The stopper 5 includes an abutting plate 5*a* which abuts against the paper sheet P discharged from the discharge port 100*f* and a support part 5*b* which supports the abutting plate 5*a*. The support part 5*b* supports the abutting plate 5*a* such that the abutting plate 5*a* stands vertically, with the detachable tray 1 installed to the receiving tray 100*e*. As depicted in FIG. 3, the support part 5*b* is installed to the receiving member 2 at a position between the receiving surface 2*a* and the downstream end of the receiving member 2 in the first direction D1 to be movable in the first direction D1.

Figure 4A:
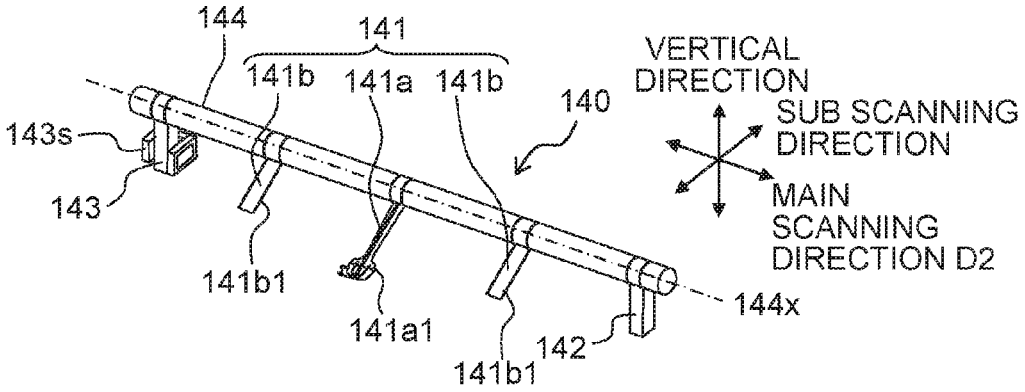
FIG. 4A is a perspective view depicting a pressing part of the printer.

As depicted in FIG. 4A, the pressing part 140 includes a pressing member 141, arms 142, 143, and a shaft 144. The shaft 144, which has a cylindrical shape, extends in the main scanning direction D2. The shaft 144 is supported by the casing 100*a* to be rotatable about an axis 144*x* extending in the main scanning direction D2. The pressing member 141 includes a center arm 141*a* and two side arms 141*b*. The center arm 141*a* and the side arms 141*b* will be simply referred to as the arm 141*a* and the arms 141*b* in some cases. Each of the arms 141*a*, 141*b*, 142, 143 is a long plate member and extends from the shaft 144. Each of the arms 141*a*, 141*b*, 142, 143 swings around the axis 144*x* along with the rotation of the shaft 144.

The center arm 141*a* is disposed in the center of the shaft 144 in the main scanning direction D2. The arms 142 and 143 are respectively disposed at a first end and a second end of the shaft 144*x* in the main scanning direction D2. One of the side arms 141*b* is disposed between the center arm 141*a* and the arm 142 in the main scanning direction D2, and the other of the side arms 141*b* is disposed between the center arm 141*a* and the arm 143 in the main scanning direction D2.

Of the arms 141*a*, 141*b*, 142, and 143, the arms 142 and 143 do not extend beyond the discharge port 100*f* and are disposed in the casing 100*a*. The arms 141*a* and 141*b* extend beyond the discharge port 100*f*.

The center arm 141*a*, which is positioned in the center of the discharge port 100*f* in the main scanning direction D2, makes contact with a center part of the paper sheet P in its width direction. The side arms 141*b*, which are positioned at a first end and a second end of the discharge port 100*f* in the main scanning direction D2, make contact with a first end and a second end of the paper sheet P in its width direction. The side arms 141*b* are equal in length, and the length of the side arms 141*b* is shorter than the length of the center arm 141*a*. A downstream end of the center arm 141*a* in the first direction D1 curves upward.

The back surfaces (surfaces facing the discharge port 100*f*) of the arms 141*a* and 141*b* are contact surfaces 141*a*1 and 141*b*1 (see FIG. 4A) which make contact with the paper sheet P discharged from the discharge port 100*f*.

The pressing member 141 is in an initial position (a position depicted by the solid line in FIG. 4B) in a state that no paper sheet P makes contact with the contact surfaces 141*a*1 and 141*b*. In this situation, no external force acts on the pressing member 141. The pressing member 141 is swingable in a swing range SR ranging from the initial position to an uppermost position (a position depicted by the alternate long and two short dashes line in FIG. 4B) through an intermediate position (a position depicted by the broken line in FIG. 4B). The initial position is a position, of the positions which can be taken by the pressing member 141, in which a downstream end of the pressing member 141 in the first direction D1 is positioned lowermost. The intermediate position is a position in which the downstream end of the pressing member 141 is positioned above the initial position. The uppermost position is a position in which the downstream end of the pressing member 141 is positioned above the initial position and the intermediate position, namely, it is positioned uppermost. The uppermost position is a position in which the downstream end of the pressing member 141 is positioned above the upper ends of the guide members 3. The swing range SR includes a first range SR1 ranging from the initial position to the intermediate position and a second range SR2 ranging from the intermediate position to the uppermost position. The second range SR2 is positioned above the first range SR1.

The pressing member 141 swings by receiving the external force from the paper sheet P when the front end of the paper sheet P discharged from the discharge port 100*f* makes contact with the contact surfaces 141*a*1 and 141*b*1. Namely, the pressing member 141 in the first range SR1 swings to reach the second range SR2. Then, the pressing member 141 in the second range SR2 swings to reach the first range SR1. When the pressing member 141 reaches the initial position or the contact surfaces 141*a*1 and 141*b*1 make contact with the paper sheet P received by the receiving surface 2*a*, the pressing member 141 comes to rest. The paper sheet P goes to the stopper 5 after swinging the pressing member 141 from the first range SR1 to the second range SR2. The paper sheet P falls on the receiving surface 2*a* after its front end abuts against the stopper 5. The paper sheet P moves in a direction opposite to the first direction D1 while being supported by the receiving surface 2*a*, and the paper sheet P stops when its rear end abuts against the abutting surface 4*a*.

Figure 4B:
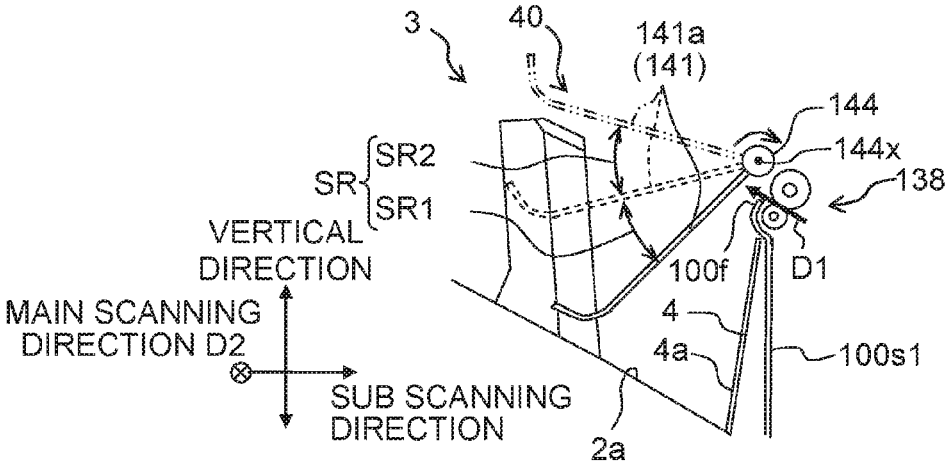
FIG. 4B is a side view depicting a swing range of a pressing member of the pressing part.
Figure 4C:
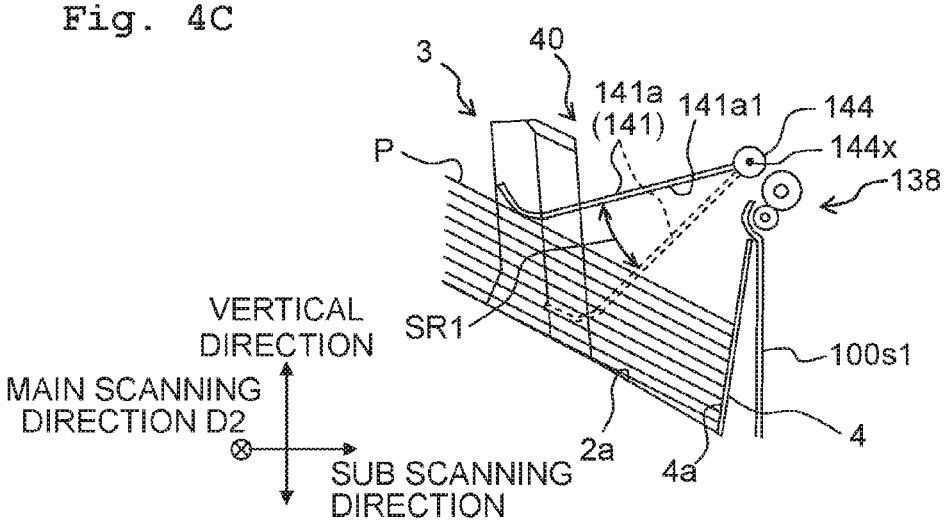
FIG. 4C is a side view depicting a state in which the pressing member swings depending on a paper sheet amount.

The pressing member 141 swings depending on the amount of the paper sheet(s) P received by the receiving surface 2*a* (see FIG. 4C). Specifically, the pressing member 141 is in the first range SR1 when no paper sheet P makes contact with the contact surfaces 141*a*1 and 141*b*1 or when a predetermined amount or less of paper sheet(s) P received by the receiving surface 2*a* make(s) contact with the contact surfaces 141*a*1 and 141*b*1. The pressing member 141 is in the intermediate position (a position depicted by the solid line in FIG. 4C) when a predetermined amount of paper sheets P is received by the receiving surface 2*a* and the contact surfaces 141*a*1 and 141*b*1 make contact with the upper most paper sheet P of the paper sheets P received by the receiving surface 2*a*. The position depicted by the broken line in FIG. 4C is the initial position.

Although FIGS. 4B and 4C depict only the center arm 141*a* of the arms 141*a* and 141*b*, the side arms 141*b* extend, similarly to the center arm 141*a*, from the shaft 144 in the same direction as that of the center arm 141*a*.

As described above, the pressing member 141 is configured to press the paper sheet P toward the receiving tray 100*e* by making the contact surfaces 141*a*1 and 141*b*1 contact with the paper sheet P discharged from the discharge port 100*f*. The pressing member 141, for example, prevents the paper sheet P from falling from the receiving tray 100*e* and prevents the paper sheet P from curling.

A full-load sensor 143S is installed to the arm 143. The full-load sensor 143S includes a light emitting part and a light receiving part disposed to face the light emitting part. The full-load sensor 143S outputs an on signal when the light receiving part receives the light emitted from the light emitting part, and the full-load sensor 143S outputs an off signal when the light receiving part receives no light. When the pressing member 141 is in the first range SR1, the light emitted from the light emitting part is blocked by the arm 143 and it is not received by the light receiving part. Thus, the full-load sensor 143S outputs the off signal. When the pressing member 141 is in the second range SR2, the light emitted from the light emitting part is received by the light receiving part without being blocked by the arm 143. Thus, the full-load sense 143S outputs the on signal. The controller 180 determines that a predetermined amount of paper sheets P is received by the receiving surface 2*a* when the controller 180 receives the on signal from the full-load sensor 143S for a predetermined time or longer. Note that the full-load sensor 143S outputs the on signal when the paper sheet P discharged from the discharge port 100*f* makes the pressing member 141 passes the intermediate position. In this case, however, the time during which the full-load sensor 143S outputs the on signal is shorter than the predetermined time. Thus, the controller 180 does not determine that the maximum amount of paper sheets P is loaded on the detachable tray 1.

The controller 180 includes a Central Processing Unit (CPU) which is an arithmetic processing unit, a Read Only Memory (ROM), a Random Access Memory (RAM), an Application Specific Integrated Circuit (ASIC), an Interface (I/F), and an Input/Output port (I/O). The ROM stores fixed data, such as programs to be executed by the CPU. The RAM temporarily stores data required for the CPU to execute each of the programs. The ASIC performs, for example, rewriting and sorting of image data (e.g., signal processing and image processing). The I/F performs data transmission and data reception with an external device, such as a personal computer connected to the printer 1. The I/O performs signal transmission and signal reception with various sensors. The CPU, which is electrically connected to respective parts of the controller 180 except for the CPU, performs control based on the data transmitted from the respective parts.

Figure 5A:
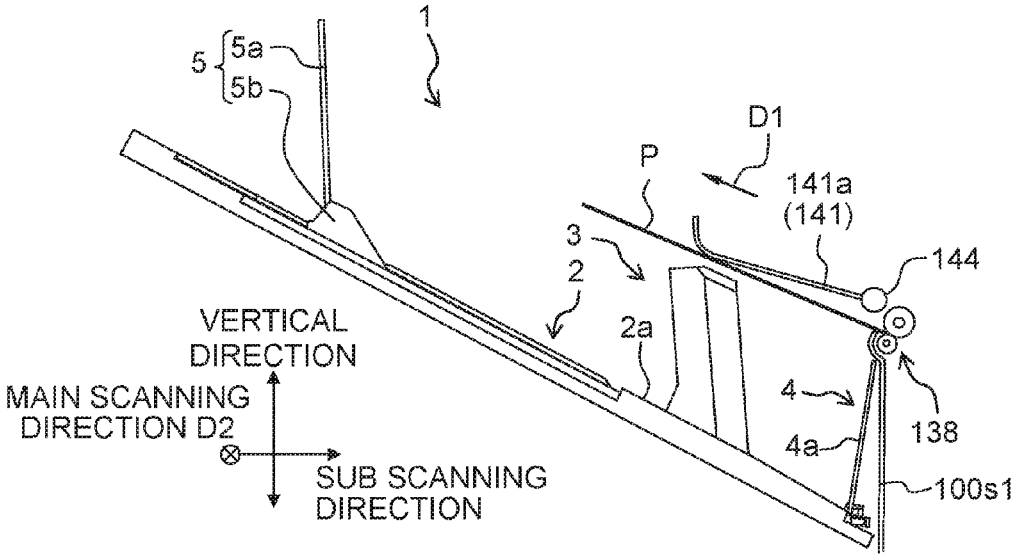
FIG. 5A is a side view depicting a state in which a paper sheet is discharged from a discharge port.
Figure 5B:
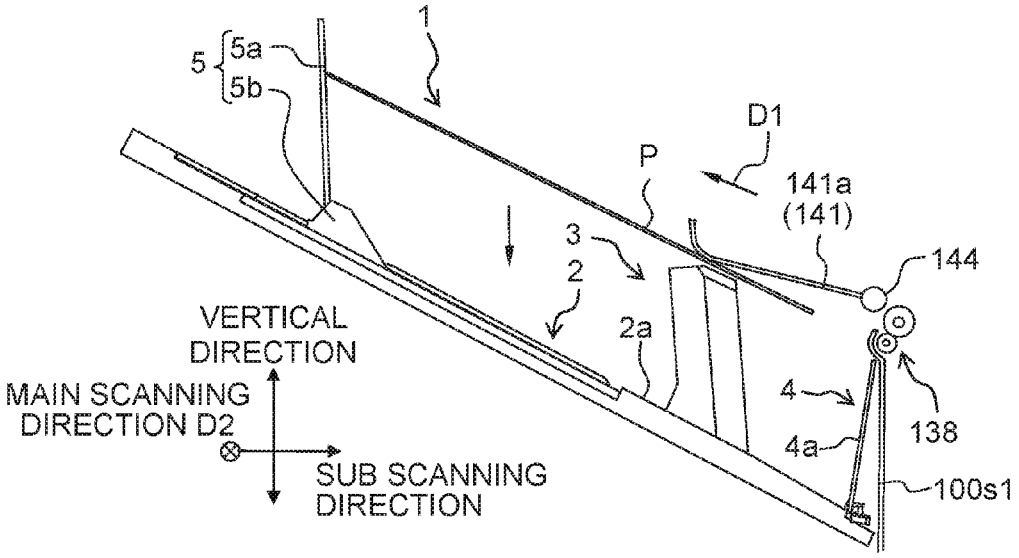
FIG. 5B is a side view depicting a state in which the discharged paper sheet abuts against a stopper.

An explanation will be made about the behavior of the paper sheet P discharged from the discharge port 100*f* with reference to FIGS. 5A to 6C. When the paper sheet P is discharged from the discharge port 100*f* by use of the roller pair 138 of the conveyance mechanism 130, the paper sheet P makes contact with the pressing member 141, as depicted in FIG. 5A. In this situation, the external force from the paper sheet P swings the pressing member 141. The downstream end of the paper sheet P in the first direction D1 passes above the guide members 3 in a state that the paper sheet P is pressed by the pressing member 141 so as not to go over the stopper 5, and the paper sheet P abuts against the abutting plate 5*a* of the stopper 5 as depicted in FIG. 5B. After that, the paper sheet P falls toward the receiving surface 2*a* because of its own weight and the pressing of the pressing member 141. The stopper 5 is positioned such that the upstream end in the first direction D1 of the paper sheet P abutting against the stopper 5 does not pass the front edges 3*a*1 of the guide members 3. In other words, the front edges 3*a*1 of the guide members 3 are disposed downstream of the upstream end in the first direction D1 of the paper sheet P abutting against the stopper 5. This prevents the paper sheet P from being caught by the front edges 3*a*1 of the tapered portions 3*a* when the paper sheet P slides on the receiving surface 2*a* to reach the abutting surface 4*a*, which will be described later.

Although the downstream end of the paper sheet P in the first direction D1 typically passes above the guide members 3 as described above, the paper sheet P may make contact with the conveyance route depending on the obliquely passing state of the paper sheet P conveyed by the conveyance mechanism 130. This may reduce the conveyance force of the paper sheet P. For example, when the downstream end of the paper sheet P makes contact with the upper ends of the front edges 3*a*1 of the guide members 3, the paper sheet P is more likely to bend between the front edges 3*a*1 of the tapered portions 3*a* and the discharge port 100*f* this is because the upper parts of the front edges 3*a*1 of the guide members 3 are further away from the discharge port 100*f* in the first direction D1 than the lower parts thereof. Helping the paper sheet P bend makes the downstream end of the paper sheet P in the first direction D1 pass the front edges 3*a*1 of the tapered portions 3*a* easily, thereby preventing the paper sheet P from getting jammed between the front edges 3*a*1 of the tapered portions 3*a* and the discharge port 100*f*. Further, since the guide members 3 include the inclined surfaces 6 respectively, the paper sheet P discharged from the discharge port 100*f* is further prevented from getting jammed between the front edges 3*a*1 of the tapered portions 3*a* of the guide members 3 and the discharge port 100*f* as compared with a case using guide members without the inclined surfaces 6.

Figure 6A:
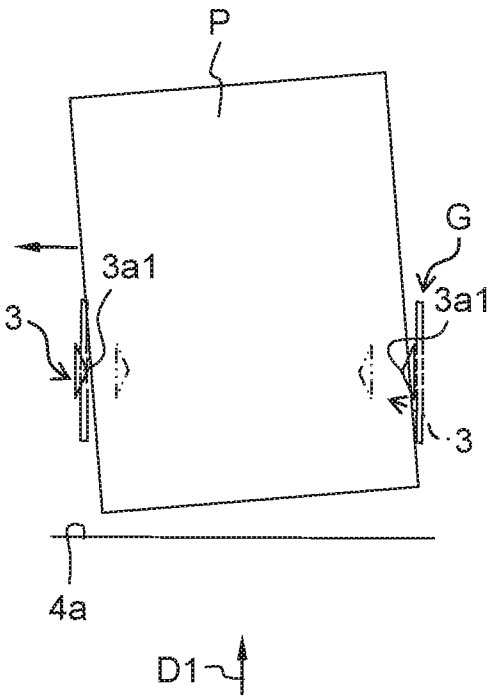
FIG. 6A is a plan view depicting a state in which the paper sheet passing obliquely falls toward a receiving surface.

The paper sheet P may be discharged from the discharge port 100*f* with skew. In this case, the paper sheet P abutting against the stopper 5 may fall toward the receiving surface 2*a* so that the right end of the paper sheet P at the upstream side in the first direction D1 overlaps with the guide member 3 in the vertical direction, as depicted in FIG. 6A. The inclined surface 8 provided for each guide member 3 moves the falling paper sheet P leftward, thereby disposing the paper sheet P between the front edges 3*a* of the guide members 3. Namely, each inclined surface 8 helps guide the paper sheet P to the receiving surface 2*a*.

Figure 6B:
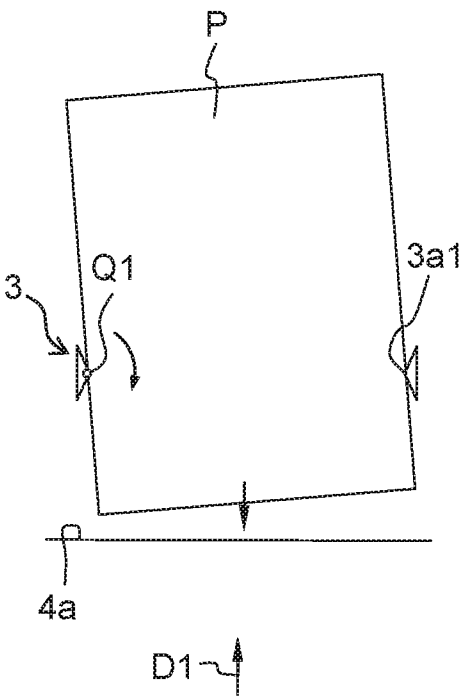
FIG. 6B is a plan view depicting a state in which the paper sheet passing obliquely slides on the receiving surface toward an abutting surface.

The paper sheet P falling on receiving surface 2*a* slides downward along the slope of the receiving surface 2*a*. As depicted in FIG. 6B, if the paper sheet P passes obliquely, the paper sheet P makes contact with the front edge 3*a*1 of the left guide member 3, rotating clockwise around a contact point Q1. This corrects the obliquely passing state of the paper sheet P.

Figure 6C:
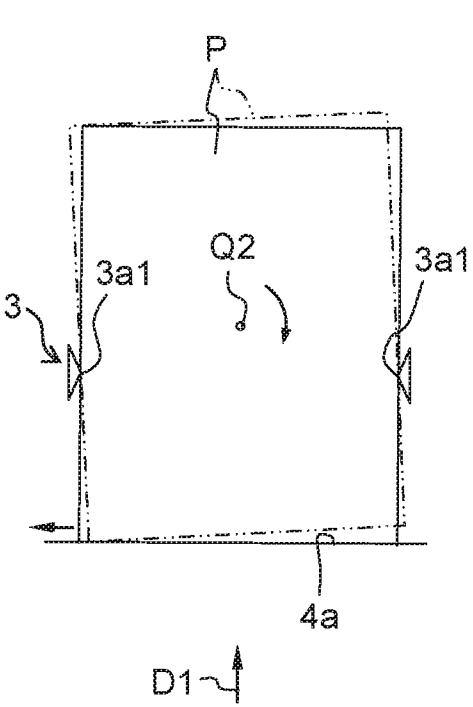
FIG. 6C is a plan view depicting a state in which the paper sheet abuts against the abutting surface.

The left end of the paper sheet P at the upstream side in the first direction D1 may abut against the abutting surface 4*a* in a state that the obliquely passing state of the paper sheet P is not corrected perfectly, as depicted by the alternate long and two short dashes line in FIG. 6C. In this case also, the paper sheet P abutting against the abutting surface 4*a* is subjected to the clockwise rotation force around a center of gravity Q2 in a state that the paper sheet P is sandwiched between the front edges 3*a*1 of the guide members 3. Since the abutting surface 4*a* is the flat surface, the left end of the paper sheet P at the upstream side in the first direction D1 moves leftward along the abutting surface 4*a* and the right end of the paper sheet P at the upstream side in the first direction D1 abuts against the abutting surface 4*a*. The obliquely passing state of the paper sheet P is corrected perfectly by allowing the whole upstream end of the paper sheet P in the first direction D1 to abut against the abutting surface 4*a*, as depicted by the solid line in FIG. 6C. Thus, if the paper sheet P which is discharged from the discharge port 100*f* onto the detachable tray 1 passes obliquely to some degree, the guide members corrects the obliquely passing state of the paper sheet P to align it therebetween.

Since the guide members 3 include the tapered portions 3*a* respectively, the distance between the guide members 3 in the main scanning direction D2 is shorter than the distance between conventional plate-shaped guide members G which are depicted by the alternate long and two short dashes line in FIG. 6A. If the distance between the conventional guide members G is shortened to have the same length as the distance between the guide members 3 of this embodiment, the paper sheet P runs on the guide members G or the paper sheet P gets jammed between the guide members G. This prevents the paper sheet P from falling on the receiving surface 2*a*. Thus, the guide members G need to be disposed outside the paper sheet P passing obliquely, namely, the guide members G need to be disposed in the positions depicted by the alternate long and two short dashes line in FIG. 6A. On the other hand, the guide members 3 of this embodiment correct the obliquely passing state of the paper sheet P to align it therebetween on the receiving surface 2*a*, despite the shorter distance between the guide members 3 in the main scanning direction D2 than the distance between the guide members D. The tapered portions 3*a* of the guide members 3 enable the short distance between the guide members 3, thereby improving the aligning property of the paper sheet P between the guide members 3.

Since the guide members 3 are configured to be movable in the main scanning direction D2, a user may erroneously dispose the guide members 3 at positions depicted by the alternate long and two short dashes lines in FIG. 6A. In this case, the distance between the guide members 3 is shorter than the width of the paper sheet P. The inclined surfaces 9 provided for the guide members 3 help dispose the paper sheet P discharged from the discharge port 100*f* on the guide members 3 without causing any paper jam between the discharge port 100*f* and the guide members 3. Positioning the paper sheet P on the guide members 3 keeps the pressing member 141 in the second range SR2. Thus, the full-load sensor 143S keeps outputting the on signal.

Figure 7:
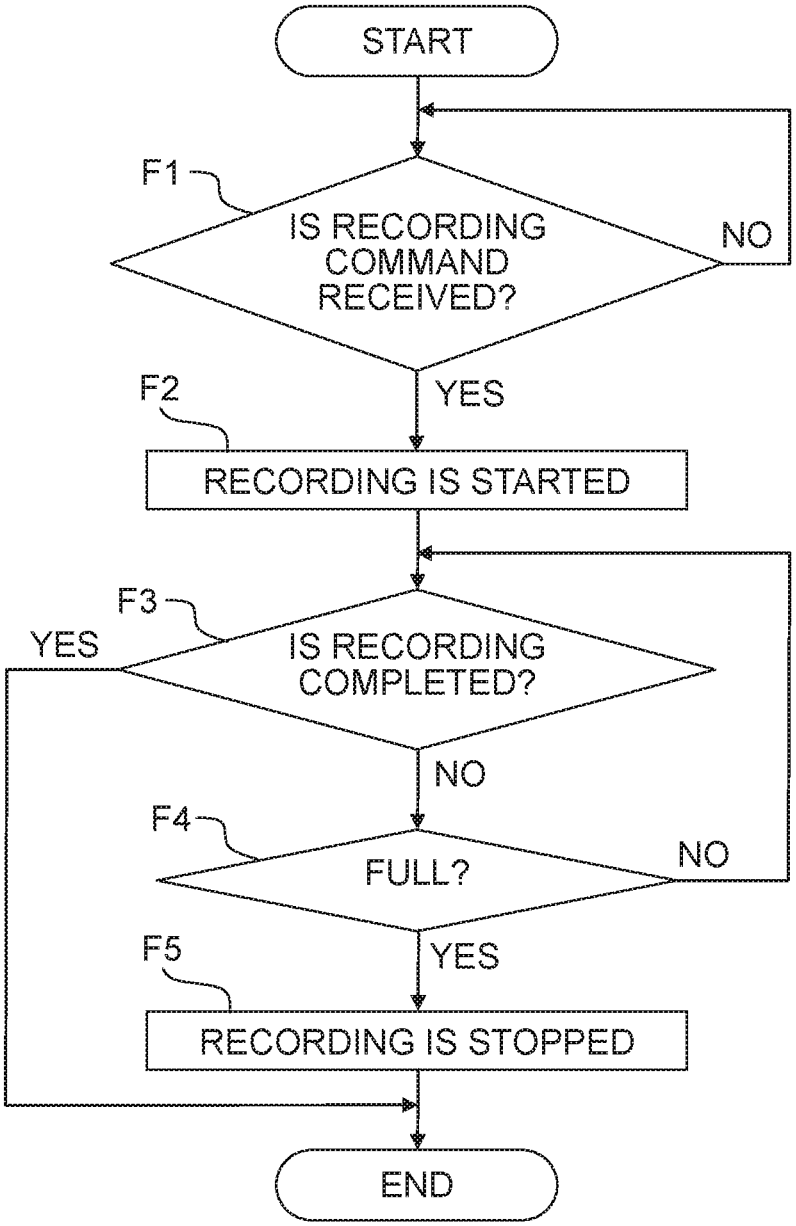
FIG. 7 is a flowchart indicating the control to be executed by a controller of the printer.

Subsequently, an explanation will be made about the control to be executed by the controller 180 with reference to FIG. 7.

First, the controller 180 determines whether it receives a recording command transmitted from an external device (F1). When the controller 180 does not receive the recording command (F1: NO), the controller 180 re-executes the processing F1. When the controller 180 receives the recording command (F1: YES), the controller 180 executes recording operation (F2).

In F2, the controller 180 controls the conveyance operation of the paper sheet P by use of the conveyance mechanism 130 and the liquid jetting operation by use of the heads 110*a*, 110*b* which are synchronized with the conveyance of the paper sheet P to record an image on the paper sheet P based on the recording command received in F1. The paper sheet P having the image recorded thereon is discharged from the discharge port 100*f* on the detachable tray 1.

Next, the controller 180 determines whether the recording for a predetermined number of paper sheets on the basis of the recording command is completed (F3). When the recording for the predetermined number of paper sheets is completed (F3: YES), the recording operation ends and this routine ends.

When the recording for the predetermined number of paper sheets is not completed (F3: NO), the controller 180 determines whether a maximum amount of paper sheets P is loaded on the detachable tray 1 based on the signal from the full-load sensor 143S (F4). When the maximum amount of paper sheets P is not loaded on the detachable tray 1 (F4: NO), the controller 180 continues the recording operation for the paper sheet P. When the maximum amount of paper sheets P is loaded on the detachable tray 1 (F4: YES), the controller 180 stops the recording operation (F5). This prevents the paper sheet P from being discharged from the discharge port 100*f* beyond an acceptable amount which can be accepted by the detachable tray 1. Any output means (not depicted), such as a speaker, may inform the user of the fact that the maximum amount of paper sheets P is loaded on the detachable tray 1. Then, this routine ends.

The user may erroneously dispose the guide members 3 such that the distance between the guide members 3 in the main scanning direction D2 is shorter than the width of the paper sheet P. In this case, the paper sheet P discharged from the discharge port 100*f* to the detachable tray 1 is disposed on the guide members 3. This makes the full-load sensor 143*s* output the on signal for the predetermined time or longer. Thus, in the processing F4, the controller 180 determines not only whether the maximum amount of paper sheets P is loaded on the detachable tray 1 but also whether the paper sheet P is disposed on or above the guide members 3. When the paper sheet P is disposed on the guide members 3, the controller 180 stops the recording operation similarly to the above case based on the signal from the full-load sensor 143S (F5). This prevents the paper sheet P from being discharged from the discharge port 100*f* in the state that the paper sheet P is disposed on the guide members 3. Then, this routine ends.

In the detachable tray 1 of the printer 100 of this embodiment, the guide members 3 include the tapered portions 3*a* respectively. Thus, the detachable tray 1 of this embodiment improves the aligning property of the paper sheet P while preventing the paper sheet P discharged from the discharge port 100*f* with skew from getting jammed between the guide members 3, without making the distance between the front edges 3*a*1 of the guide members 3 significantly longer than the width of the paper sheet P.

The guide members 3 are supported by the receiving member 2 to be movable in the main scanning direction D2. Thus, the distance between the guide members 3 in the main scanning direction D2 is adjusted depending on the size of the paper sheet P.

The stopper 5 is supported by the receiving member 2 to be movable in the first direction D1. Thus, the position of the stopper 5 is adjusted depending on the size of the paper sheet P.

The guide members 3 are disposed such that the front edges 3*a*1 of the tapered portions 3*a* face each other in the main scanning direction D2. This allows the distance between the guide members 3 in the main scanning direction D2 to be shorter than the case in which the distance between the guide members 3 in the main scanning direction D2 is longer than the width of the paper sheet P, but the front edges 3*a*1 of the tapered portions 3*a* are displaced from each other in a direction parallel to the receiving surface 2*a* and orthogonal to the main scanning direction D2. Thus, the aligning property of the paper sheet P on the receiving surface 2*a* can be improved. The guide members 3 of which front edges 3*a*1 are displaced from each other need to increase a distance between the guide members 3 according to its displacement amount, like the guide members G. Otherwise, the paper sheet P may get jammed between the guide members 3.

The front edges 3*a*1 of the tapered portions 3*a* are formed to come into point contact with the paper sheet P. This allows the distance between the guide members 3 in the main scanning direction D2 to be shorter than the case in which parts making contact with the paper sheet P have a shape parallel to the receiving surface 2*a* and long in the direction orthogonal to the main scanning direction D2. The aligning property of the paper sheet P is improved, accordingly.

The detachable tray 1 includes the abutting member 4 having the flat abutting surface 4*a*. This makes it possible to correct the obliquely passing state of the paper sheet P, even when the surface of the side wall 100*s*1 of the receiving tray 100*e* which faces the abutting member 4 has, for example, a concavo-convex shape.

Figure 8:
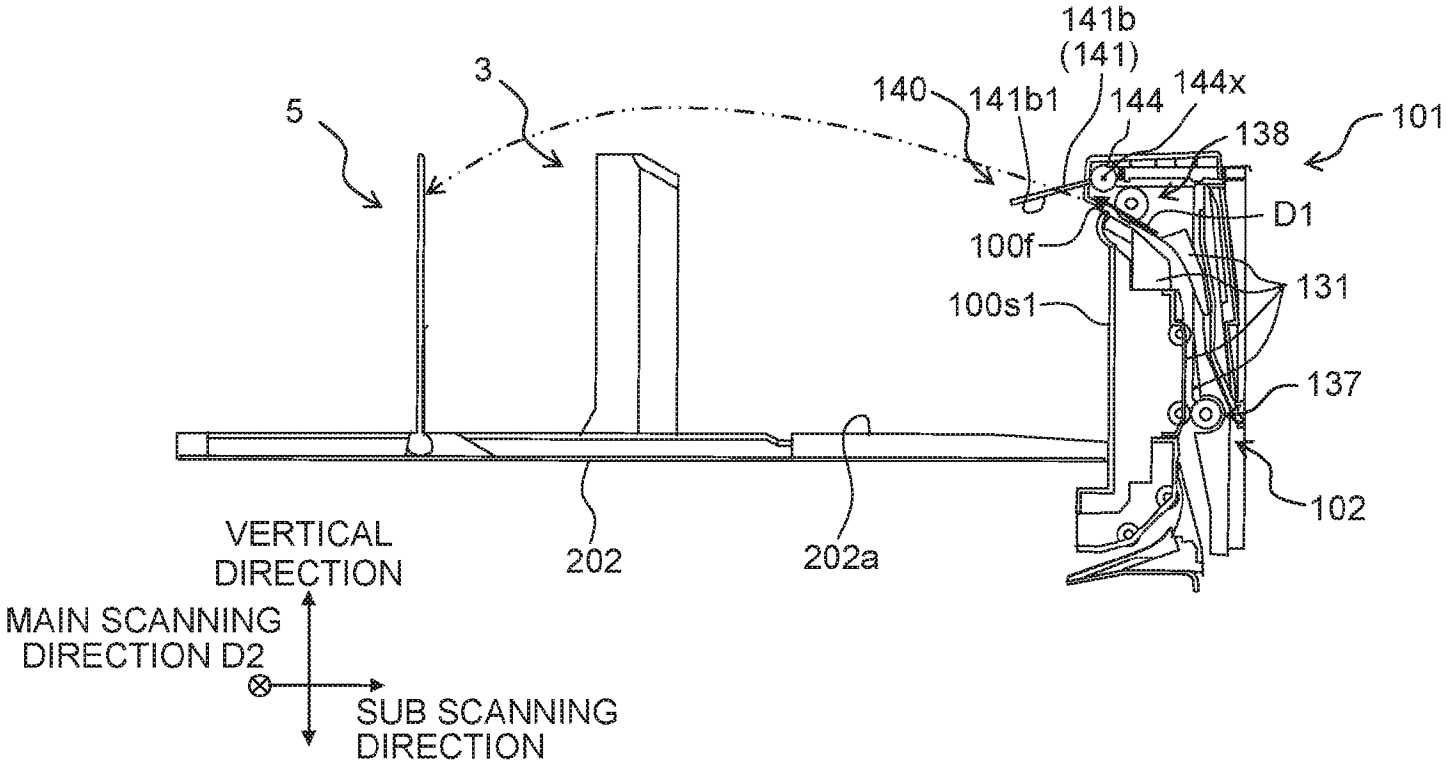
FIG. 8 is a partial side view of the discharge apparatus to which a detachable tray of a first modified example is installed.

The receiving member 2 of the above embodiment includes the receiving surface 2*a* which is inclined such that its downstream end is positioned above its upstream end in the first direction D1. The receiving member 2, however, may be horizontal. In a first modified example, a receiving member 202, which is constructed of a flat-plate member as depicted in FIG. 8, includes a horizontal receiving surface 202*a*. In this case, the stopper 5 is an abutting member which abuts against the downstream end in the first direction D1 of the paper sheet P received by the receiving surface 202*a*. Thus, the abutting member 4 is not provided in the receiving member 202.

In the first modified example also, the paper sheet P discharged from the discharge port 100*f* abuts against the stopper 5 after its downstream end in the first direction D1 passes through above the guide members 3. The alternate long and two short dashes line of FIG. 8 indicates a movement locus of the downstream end of the paper sheet P in the first direction D1. The paper sheet P falls toward the receiving surface 202*a* by its own weight and the pressing force of the pressing member 141 after the downstream end of the paper sheet P in the first direction D1 passes through above the guide members 3 before it abuts against the stopper 5. The guide members 3 are disposed to make contact with both sides in the main scanning direction D2 of the paper sheet P falling toward the receiving surface 202*a*. Thus, the front edges 3*a*1 of the tapered portions 3*a* of the guide members 3 correct the obliquely passing state of the paper sheet P falling toward the receiving surface 202*a* before the downstream end of the paper sheet P in the first direction D1 abuts against the stopper 5. In the first modified example also, the guide members 3 include the tapered portions 3*a* respectively. Thus, the guide members 3 of the first modified example improve the aligning property of the paper sheet P while preventing the paper sheet P discharged from the discharge port 100*f* with skew from getting jammed between the guide members 3, without making the distance between the front edges 3*a* of the guide members 3 significantly longer than the width of the paper sheet P. The parts which are formed similarly to those of the above embodiment can obtain the effects similar to the above embodiment. Further, the receiving surface 202*a* is horizontal. Thus, when the paper sheet P discharged from the discharge port 100*f* falls on the receiving surface 202*a* after its downstream end in the first direction D1 passes through above the guide members 3 before it abuts against the stopper 5, the paper sheet P can easily move along the receiving surface 202*a* in the first direction D1. Namely, the receiving surface 202*a* helps the rotation and alignment of the paper sheet P discharged from the discharge port 100*f* with skew.

Figure 9:
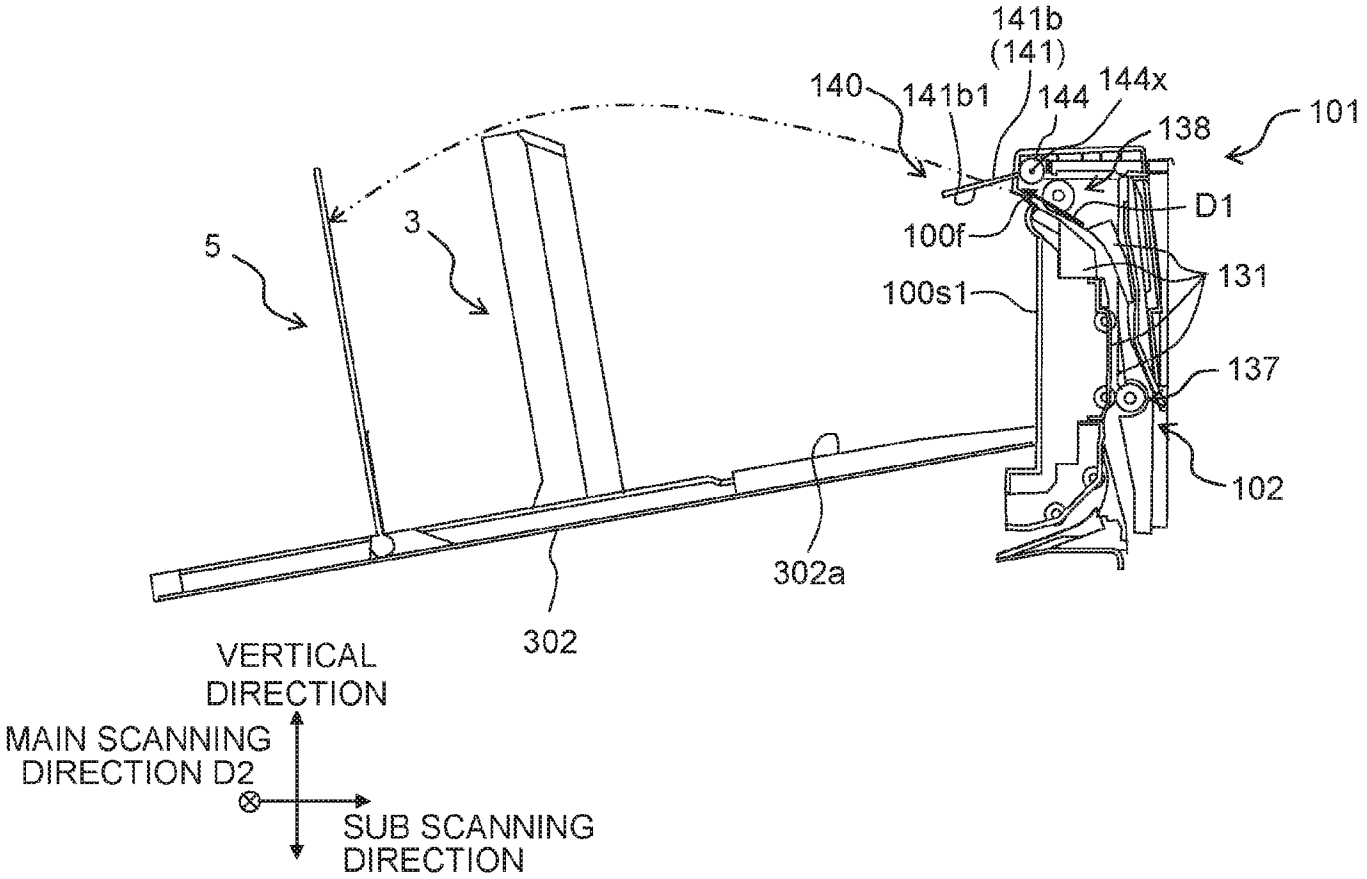
FIG. 9 is a partial side view of the discharge apparatus to which a detachable tray of a second modified example is installed.

The receiving surface may be inclined such that its downstream end is positioned below its upstream end. In a second modified example, a receiving member 302, which is constructed of a flat-plate member as depicted in FIG. 9, includes a receiving surface 302*a* which is inclined such that its downstream end is positioned below its upstream end in the first direction D1. In this case also, the stopper 5 is an abutting member which abuts against the downstream end in the first direction D1 of the paper sheet P received by the receiving surface 302*a*. Thus, the abutting member 4 is not provided in the receiving member 302. In this configuration, since the downstream end of the receiving member 302 in the first direction D1 is disposed below the upstream end, the longitudinal lengths of the stopper 5 and the guide members 3 are longer than those of the above embodiment.

In the second modified example also, the paper sheet P discharged from the discharge port 100*f* abuts against the stopper 5 after its downstream end in the first direction D1 passes through above the guide members 3. The alternate long and two short dashes line of FIG. 9 indicates a movement locus of the downstream end of the paper sheet P in the first direction D1. The paper sheet P falls toward the receiving surface 302*a* by its own weight and the pressing force of the pressing member 141 after the downstream end of the paper sheet P in the first direction D1 passes through above the guide members 3 before it abuts against the stopper 5. Like the first modified example, the guide members 3 are disposed to make contact with both sides in the main scanning direction D2 of the paper sheet P falling toward the receiving surface 302*a*. Thus, the front edges 3*a*1 of the tapered portions 3*a* of the guide members 3 correct the obliquely passing state of the paper sheet P falling toward the receiving surface 302*a* before the downstream end of the paper sheet P in the first direction D1 abuts against the stopper 5. The second modified example can also obtain the effects similar to those of the first modified example. The receiving surface 302*a* is inclined such that its downstream end is positioned below its upstream end. Thus, when the paper sheet P discharged from the discharge port 100*f* falls on the receiving surface 302*a* after its downstream end in the first direction D1 passes through above the guide members 3 before it abuts against the stopper 5, the paper sheet P can easily move along the receiving surface 302*a* in the first direction D1. Namely, the receiving surface 302*a* helps the rotation and alignment of the paper sheet P discharged from the discharge port 100*f* with skew.

Figure 10:
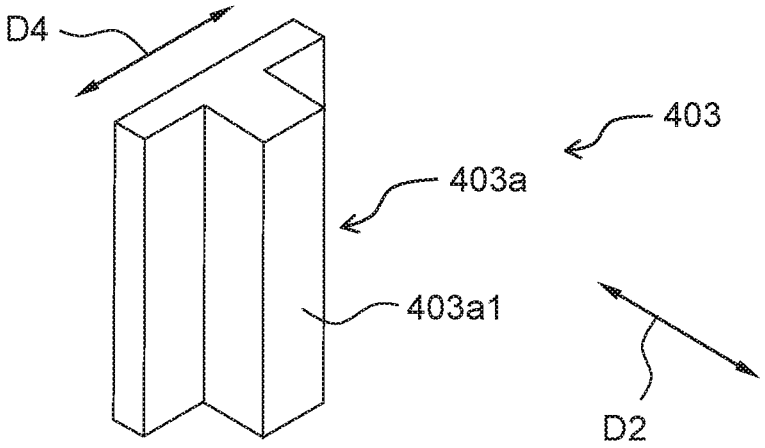
FIG. 10 is a perspective view of a guide member according to a third modified example.

The following describes modified examples of the guide member 3. As depicted in FIG. 10, a guide member 403 may include a prismatic column 403*a* which functions similarly to the tapered portion 3*a* of the guide member 3. In the guide member 403 of a third modified example, the prismatic column 403*a* has a flat plate 403*a*1 which functions similarly to the front edge 3*a*1. The length of the prismatic column 403*a* in a width direction D4 (a direction parallel to the receiving surface and orthogonal to the main scanning direction) of the guide member 403 is shorter than the whole width of the guide member 403. This allows the distance between the guide members 403 in the main scanning direction D2 to be short, resulting in the same effects as those of the above embodiment.

Figure 11:
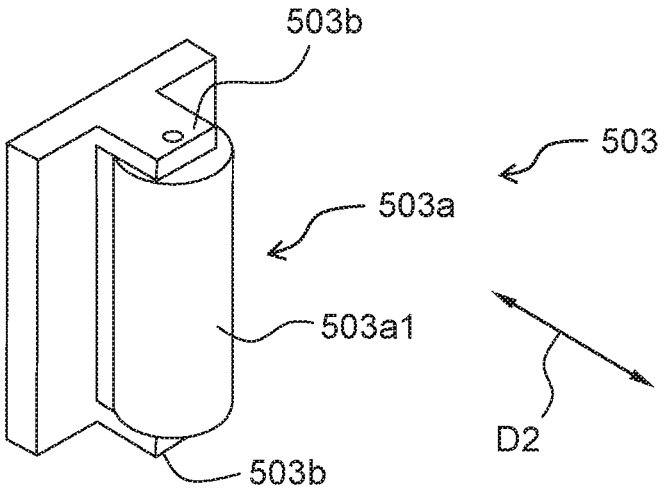
FIG. 11 is a perspective view of a guide member according to a fourth modified example.

As depicted in FIG. 11, a guide member 503 may include a roller 503*a* which functions similarly to the tapered portion 3*a* of the guide member 3. The roller 503*a* is rotatably supported by flanges 503*b* formed at both ends of the guide member 503 in its longitudinal direction. In the guide member 503 of a fourth modified example, an innermost part 503*a*1, of the roller 503*a*, positioned innermost in the main scanning direction D2 functions similarly to the front edge 3*a*1. The innermost part 503*a*1 can come into point contact with the paper sheet P. This allows the guide member 503 to obtain the same effects as the above embodiment.

Figure 12:
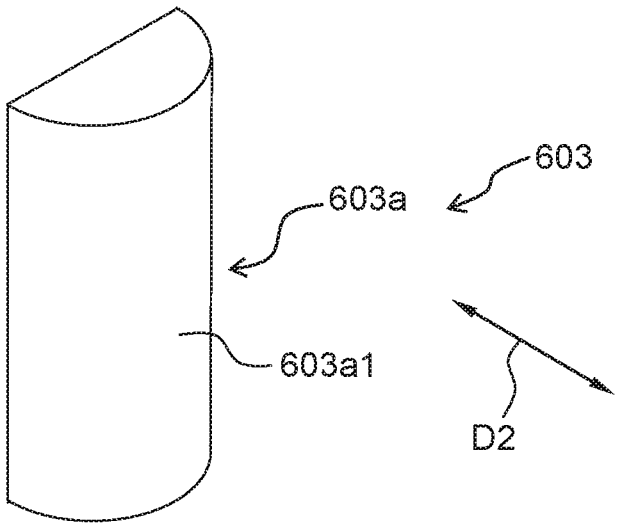
FIG. 12 is a perspective view of a guide member according to a fifth modified example.

As depicted in FIG. 12, a guide member 603 may be constructed of a semicircular column. In the guide member 603 of a fifth modified example, like the roller 503*a* of the fourth modified example, a curved surface 603*a* functions similarly to the tapered portion 3*a* and an innermost part 603*a*1, of the curved surface 603*a*, positioned innermost in the main scanning direction D2 functions similarly to the front edge 3*a*1. The innermost part 603*a*1 can come into point contact with the paper sheet P. This allows the guide member 603 to obtain the same effects as the above embodiment. The guide member may be constructed of a cylindrical member or a triangular prism member. These modified example can obtain the same effects as the above embodiment.

In the above description, the preferred embodiment of the present teaching is explained. The present teaching, however, is not limited thereto, and may have various modifications without departing from the gist and scope of the patent claims below. For example, although the discharge apparatus 101 is configured by installing the detachable tray 1 on the receiving tray 100*e* in the above embodiment, the discharge apparatus may be configured by incorporating a component or structure equivalent to the detachable tray 1 into the receiving tray 100*e*. Namely, the receiving member 2 may be constructed of the upper wall 100*t*, the guide members 3 and the stopper 5 may be provided in the upper wall 100*t*, and the abutting member 4 may be constructed of the side wall 100*s*1. The discharge apparatus with such a configuration can obtain the same effects as the above embodiment.

The position, in the printer, to which the detachable tray 1 is installed (i.e., the position of the receiving tray) is not limited to the upper part of the casing, and it may be, for example, a side part of the casing. Each guide member (a protruding portion of the present teaching) may extend in the vertical direction, or may be inclined toward the discharge port 100*f* from its lower side to its upper side.

In the above embodiment, the stopper 5 may not be provided; each of the guide members 3 may not have the inclined surfaces 6 to 9; each of the guide members 3 may be fixed to the receiving member 2 so as not to be movable; the stopper 5 may be fixed to the receiving member 2 so as not to be movable; the sensor 143S detecting whether the paper sheet P is positioned on or above the guide members 3 may not be provided; and the guide members 3 may be disposed such that the front edges 3*a*1 are slightly displaced from each other in the direction parallel to the receiving surface 2*a* and orthogonal to the main scanning direction D2.

Although the abutting member 4 is constructed of the flat plate in the above embodiment, it may be constructed of bar-like members disposed between the center and both ends in the main scanning direction D2 of the paper sheet P received by the receiving surface 2*a*. The bar-like members may be disposed on the inside, in the main scanning direction D2, of an upstream corner of the paper sheet P in the first direction D1. In that case, if the paper sheet P slides on the receiving surface 2*a* obliquely toward the bar-like members, the obliquely passing state of the paper sheet P can be corrected by making the paper sheet P abut against the bar-like members.

In the above description, the examples in which the present teaching is applied to the printer which jets the ink from nozzles to perform recording are explained. The present teaching, however, is not limited thereto. The discharge apparatus may be any apparatus discharging a recording medium. The recording medium is not limited to the paper sheet, and it may be, for example, cloth. The present teaching is applicable to any other liquid jetting apparatus than the printer which jets any other liquid than the ink from jetting ports. The present teaching is applicable to both of a line-type apparatus and a serial-type apparatus. The recording unit is not limited to the ink-jet system, and it may be a laser system, a thermal system, or the like.

What is claimed is:

1. A discharge apparatus, comprising:

a discharge mechanism including a discharge port and configured to discharge a recording medium from the discharge port in a first direction;

a receiving member having a receiving surface which receives the recording medium discharged from the discharge port;

an abutting member having an abutting surface which abuts against an upstream end or a downstream end in the first direction of the recording medium received by the receiving surface, and;

guide members extending upward beyond the receiving surface and configured to guide the recording medium, which is discharged from the discharge port to fall toward the receiving surface, from both sides in a second direction orthogonal to the first direction and parallel to the receiving surface, wherein the guide members respectively include protruding portions protruding inward in the second direction and extending in a longitudinal direction of the guide members, the guide members are disposed at positions where leading ends of the protruding portions make contact with both sides in the second direction of the recording medium which is discharged from the discharge port to fall toward the receiving surface, the guide members have first extending portions extending from upstream ends of the guide members in the first direction to the leading ends of the protruding portions respectively, and second extending portions extending from downstream ends of the guide members in the first direction to the leading ends of the protruding portions respectively, each of the leading ends of the protruding portions is formed in a shape coming into point contact with the recording medium, and the discharge apparatus has a space between the guide members and the abutting member, with respect to the first direction.

2. The discharge apparatus according to claim 1, further comprising a stopper having an upper end positioned above the receiving surface, being disposed downstream of the receiving surface in the first direction, and abutting against the downstream end in the first direction of the recording medium discharged from the discharge port, wherein the receiving surface is inclined such that a downstream end of the receiving surface in the first direction is positioned above an upstream end of the receiving surface in the first direction, the abutting surface is disposed upstream of the receiving surface in the first direction to abut against the upstream end in the first direction of the recording medium received by the receiving surface, and the leading ends of the protruding portions are disposed to make contact with both sides in the second direction of the recording medium which is discharged from the discharge port to abut against the stopper.

3. The discharge apparatus according to claim 2, wherein the stopper is supported by the receiving member to be movable in a direction orthogonal to the second direction and parallel to the receiving surface.

4. The discharge apparatus according to claim 1, wherein the receiving surface extends horizontally.

5. The discharge apparatus according to claim 1, wherein the receiving surface is inclined such that an upstream end of the receiving surface in the first direction is positioned above a downstream end of the receiving surface in the first direction.

6. The discharge apparatus according to claim 1, wherein the leading ends of the protruding portions extend while being inclined downstream in the first direction from a lower side of the leading ends to an upper side of the leading ends.

7. The discharge apparatus according to claim 1, wherein the first extending portions are first inclined surfaces which are inclined inward in the second direction from upstream ends of the guide members in the first direction to the leading ends of the protruding portions.

8. The discharge apparatus according to claim 1, wherein upper ends of the guide members are provided with second inclined surfaces, respectively, which are inclined upward from inner ends of the second inclined surfaces in the second direction to outer ends of the second inclined surfaces in the second direction, and the second inclined surfaces extend from upstream ends of the upper ends in the first direction to downstream ends of the second inclined surfaces in the first direction.

9. The discharge apparatus according to claim 1, wherein the guide members are supported by the receiving member to be movable in the second direction.

10. The discharge apparatus according to claim 9, wherein upper ends of the guide members are provided with third inclined surfaces, respectively, which are inclined upward from upstream ends of the third inclined surfaces in the first direction to downstream ends of the third inclined surfaces in the first direction, and the third inclined surfaces extend from upstream ends of the upper ends in the first direction to the downstream ends of the third inclined surfaces in the first direction.

11. The discharge apparatus according to claim 10, further comprising:

a controller configured to control the discharge mechanism; and a detection unit configured to detect the recording medium in a case that the recording medium discharged from the discharge port is disposed on the guide members, wherein the controller is configured to stop discharge of the recording medium from the discharge port based on a signal which is outputted from the detection unit and indicates that the recording medium is disposed on the guide members.

12. The discharge apparatus according to claim 1, wherein the leading ends of the protruding portions are disposed to face each other in the second direction.

13. A detachable tray to be installed to a receiving tray of a discharge apparatus, the discharge apparatus including: a discharge mechanism including a discharge port and configured to discharge a recording medium from the discharge port in a first direction; and the receiving tray configured to receive the recording medium discharged from the discharge port, the detachable tray comprising:

a receiving member disposed on the receiving tray and having a receiving surface which receives the recording medium discharged from the discharge port an abutting member disposed upstream of the receiving surface in the first direction and having an abutting surface which abuts against an upstream end in the first direction of the recording medium received by the receiving surface; and guide members extending upward beyond the receiving surface and configured to guide the recording medium, which is discharged from the discharge port to fall toward the receiving surface, from both sides in a second direction orthogonal to the first direction and parallel to the receiving surface, wherein the guide members respectively include protruding portions protruding inward in the second direction and extending in a longitudinal direction of the guide members, the guide members are disposed at positions where leading ends of the protruding portions make contact with both sides in the second direction of the recording medium which is discharged from the discharge port to fall toward the receiving surface, the guide members have first extending portions extending from upstream ends of the guide members in the first direction to the leading ends of the protruding portions respectively, and second extending portions extending from downstream ends of the guide members in the first direction to the leading ends of the protruding portions respectively, each of the leading ends of the protruding portions is formed in a shape coming into point contact with the recording medium, and the discharge apparatus has a space between the guide members and the abutting member, with respect to the first direction.

14. The detachable tray according to claim 13, further comprising a stopper provided for the receiving member, having an upper end positioned above the receiving surface, being disposed downstream of the receiving surface in the first direction, and abutting against a downstream end in the first direction of the recording medium discharged from the discharge port, wherein the receiving surface is inclined such that a downstream end of the receiving surface in the first direction is positioned above an upstream end of the receiving surface in the first direction, and the leading ends of the protruding portions are disposed to make contact with both sides in the second direction of the recording medium which is discharged from the discharge port to abut against the stopper.

15. The detachable tray according to claim 14, wherein the abutting surface is flat in the second direction.

* * * * *